US008251537B2

(12) United States Patent
Lee

(10) Patent No.: US 8,251,537 B2
(45) Date of Patent: Aug. 28, 2012

(54) LAMP TUBE COUPLER

(75) Inventor: Ming-Shun Lee, Taipei (TW)

(73) Assignee: Taiwan Oasis Technology Co., Ltd, Taipei (TW)

( * ) Notice: Subject to any disclaimer, the term of this patent is extended or adjusted under 35 U.S.C. 154(b) by 107 days.

(21) Appl. No.: 12/954,867

(22) Filed: Nov. 27, 2010

(65) Prior Publication Data

US 2011/0143598 A1 Jun. 16, 2011

(30) Foreign Application Priority Data

Dec. 10, 2009 (TW) ..... 98223113 U

(51) Int. Cl.
*F21V 4/00* (2006.01)

(52) U.S. Cl. ..... 362/219; 362/225; 362/249.01; 439/700; 439/243

(58) Field of Classification Search ..... 362/217.16, 362/219, 224, 225, 227, 260, 378; 439/243, 439/244, 700, 824
See application file for complete search history.

(56) References Cited

U.S. PATENT DOCUMENTS

| | | | | |
|---|---|---|---|---|
| 4,092,562 | A * | 5/1978 | Campbell | 315/189 |
| 5,357,412 | A * | 10/1994 | Entrop et al. | 362/219 |
| 5,565,728 | A * | 10/1996 | Jung | 313/51 |
| 5,702,176 | A * | 12/1997 | Engle | 362/219 |
| 5,904,415 | A * | 5/1999 | Robertson et al. | 362/260 |
| 6,964,495 | B2 * | 11/2005 | Schnaufer et al. | 362/378 |
| 7,484,980 | B2 * | 2/2009 | Liao | 439/236 |
| 7,488,086 | B2 * | 2/2009 | Wu et al. | 362/225 |
| 7,513,640 | B2 * | 4/2009 | Hendrikus | 362/219 |
| 2008/0165530 | A1 * | 7/2008 | Hendrikus | 362/227 |

* cited by examiner

*Primary Examiner* — Hargobind S Sawhney
(74) *Attorney, Agent, or Firm* — Jackson IPG PLLC

(57) ABSTRACT

A lamp tube coupler is that an insulation terminal seat is respectively disposed to two ends of an expansible outer cylinder. A pair of electrode coupling members is disposed to each insulation terminal seat. The electrode coupling members corresponding to each other at the two ends of the expansible outer cylinder form a conduction mode through respective springs. While using every lamp tube coupler, the coupler is disposed between the two lamp tubes. The electrode coupling members at two ends are respectively inserted into the electrode sockets of the two lamp tubes to achieve the goal of cascading at least two lamp tubes.

9 Claims, 6 Drawing Sheets

LAMP TUBE COUPLER

BACKGROUND OF THE INVENTION

1. Field of the Invention

The present invention relates to an electrical coupling device, and more particularly to a lamp tube coupler provided for cascading fluorescent lamp tubes or light emitting diode lamp tubes to satisfy the intervals of the electrode sockets of the lamp holder.

2. Description of the Related Art

With reference to FIG. 1 for a schematic diagram of a basic assembly of conventional illumination equipment of a fluorescent lamp is shown. The fluorescent lamp mainly comprises a fluorescent lamp tube 11 and a lamp holder 12. The fluorescent lamp tube 11 has a lamp tube body 111 and endcaps 112 at two ends of the body 111. A pair of electrode joints (not shown in the figure) is respectively disposed to each endcap 112.

The lamp holder 12 has a lamp holder body 121 and two electrode sockets 122. Each electrode socket is respectively disposed to two ends of the lamp holder body 121 and has a pair of electrode inserting holes (not shown in the figure). While in use, the fluorescent lamp tube 11 is inserted into the electrode inserting holes of the lamp holder 12 through the electrode joints of the endcaps 112 to achieve the goal of electrical connection.

In recent years, conventional lamp bulbs or fluorescent lamp tubes are gradually replaced with the use of light emitting diode lamps. However, to satisfy all present lamps that react to the transitional demands between new and old products, conventional products such as light emitting diode lamps are usually designed to match the structural type of the present lamps. For example, the shape of a light emitting diode lamp tube also has a light transmissive tube and endcaps and electrode joints that are disposed to two ends of the light transmissive tube by imitating the conventional fluorescent lamp tube. Thus the light emitting diode lamp tube can be commonly applied to the lamp holder of the conventional fluorescent lamp tube.

However, the length of the conventional fluorescent lamp tube is also different since it has different specifications of 10, 20, and 40 watts. Therefore, the fluorescent lamp which is seen on the street is divided into specific specifications with 10, 20, and 40 watts as well. The intervals of the electrode sockets belonging to the different specifications of the fluorescent lamps are different. In principle, only fluorescent lamp tubes with specific lengths can be applied for installation. The foregoing conventional technique has worse applicability and can not interchange lamp tubes with different lengths and specifications. Consequently, the cost of repeatedly purchasing lamp tubes is relatively increased.

SUMMARY OF THE INVENTION

In view of the shortcomings of the prior art, the inventor of the present invention based on years of experience in the related industry to conduct extensive researches and experiments, and finally developed a lamp tube coupler for cascading fluorescent tubes or light emitting diode lamp tubes to satisfy the intervals of the electrode sockets of a lamp holder, thereby increasing the adaptability of the lamp tubes and lamp holders.

To achieve the foregoing objective, the lamp tube coupler of the present invention is that two ends of an expansible outer cylinder have an insulation terminal seat respectively. A pair of electrode coupling members is disposed to each insulation terminal seat. The electrode coupling members corresponding to each other at the two ends of the expansible outer cylinder form a conduction mode through respective springs.

While using every lamp tube coupler, the coupler is disposed between two lamp tubes, and the electrode coupling members at two ends are respectively inserted into electrode sockets of two lamp tubes to achieve a goal of cascading at least two lamp tubes.

DETAILED DESCRIPTION OF THE PREFERRED EMBODIMENTS

The foregoing and other technical characteristics of the present invention will become apparent with the detailed description of the preferred embodiments and the illustration of the related drawings.

Figure 1:
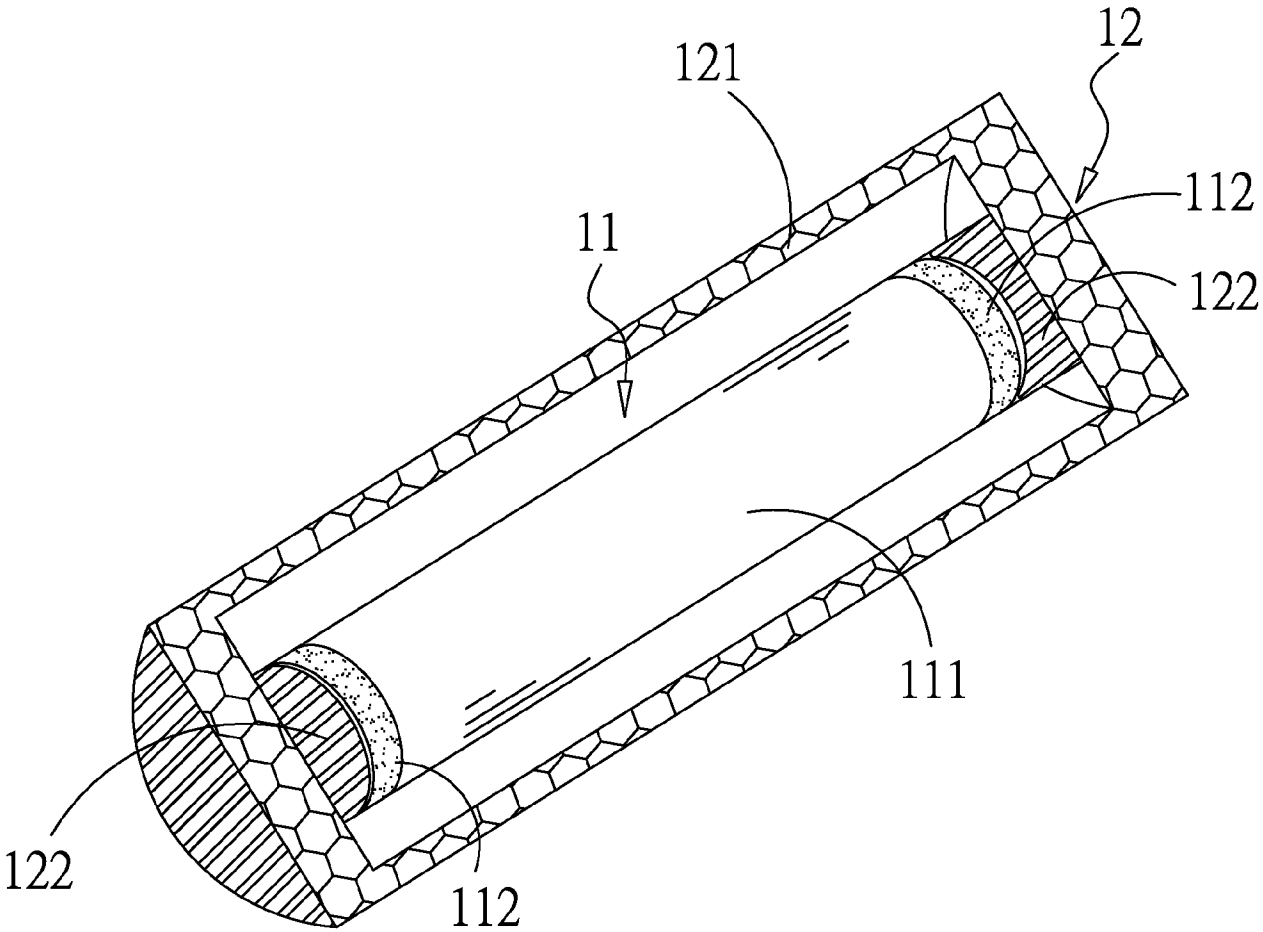
FIG.1 PRIOR ART
FIG. 1 is a schematic diagram of a basic structure of a conventional fluorescent lamp.
Figure 2:
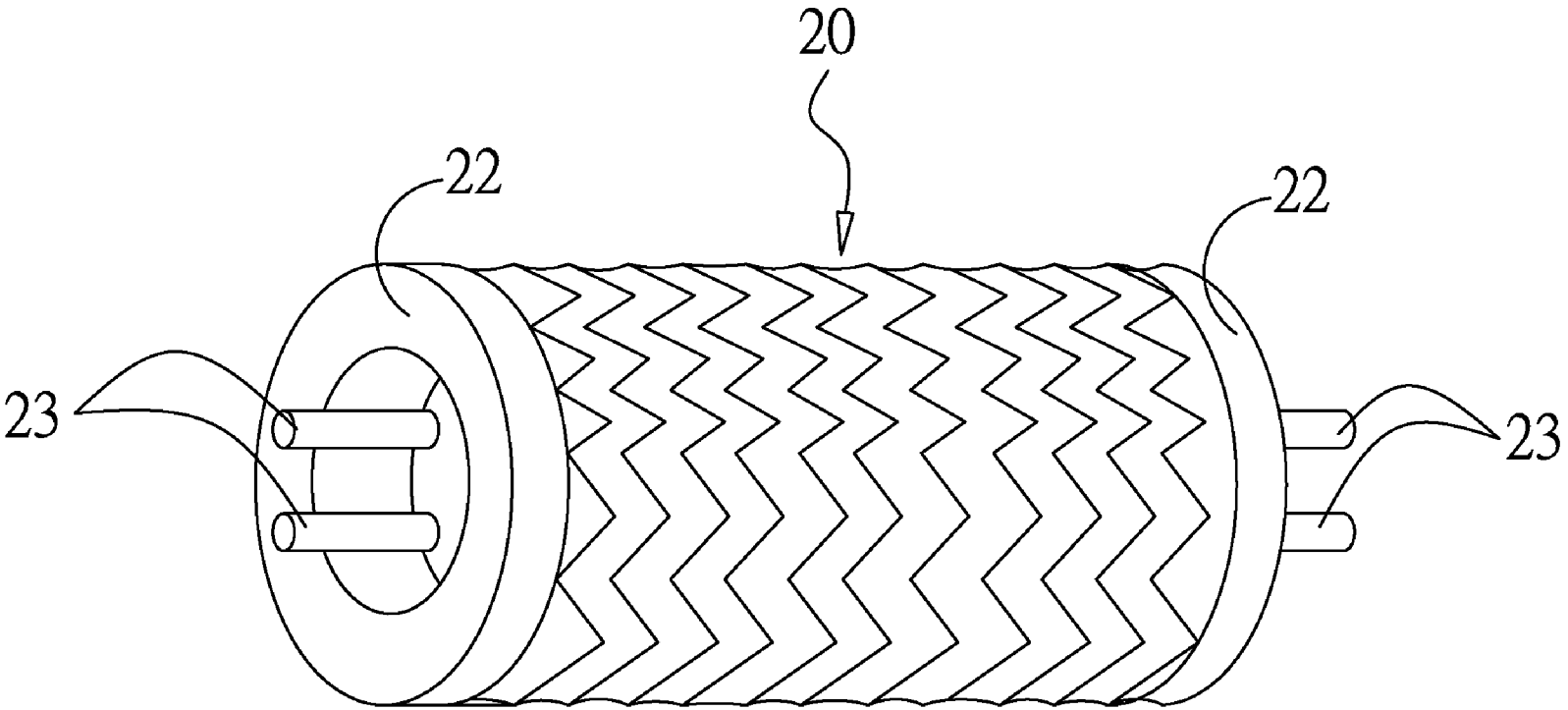
FIG. 2 is a structural diagram of a lamp tube coupler according to a first embodiment of the present invention.
Figure 3:
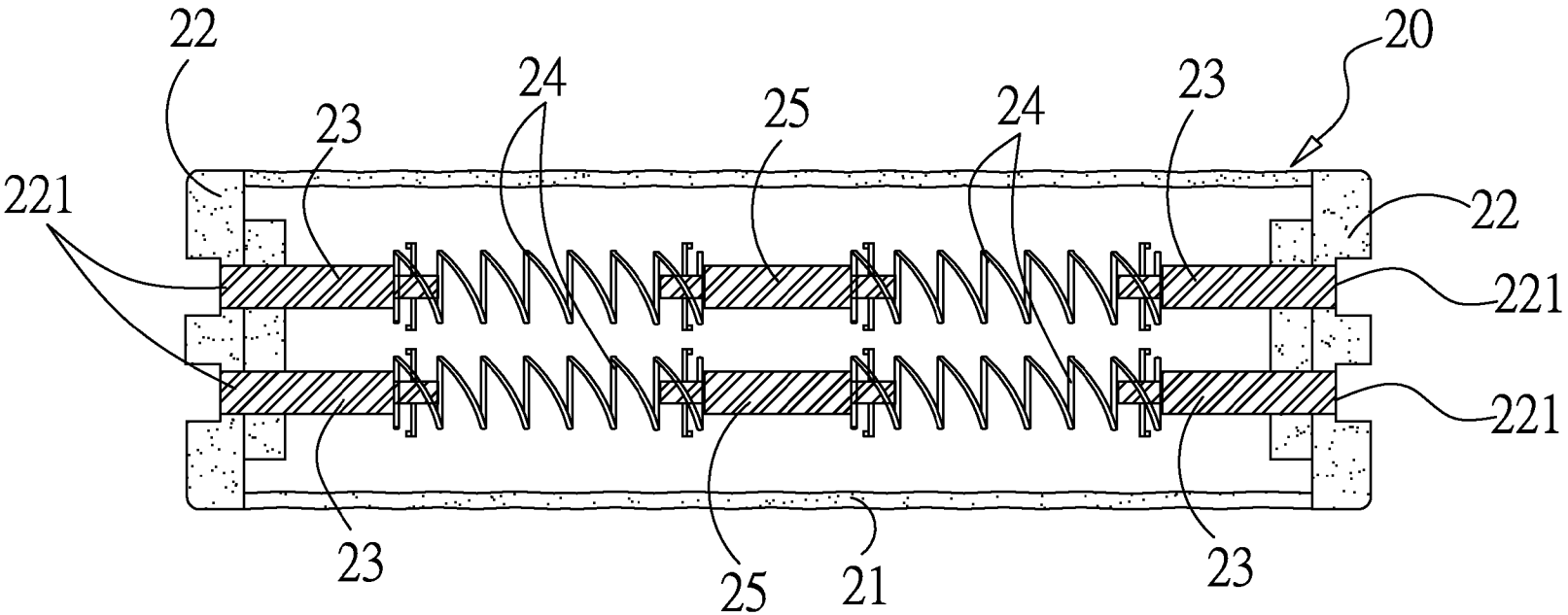
FIG. 3 is a cross-sectional drawing of a lamp tube coupler according to a first embodiment of the present invention.
Figure 4:
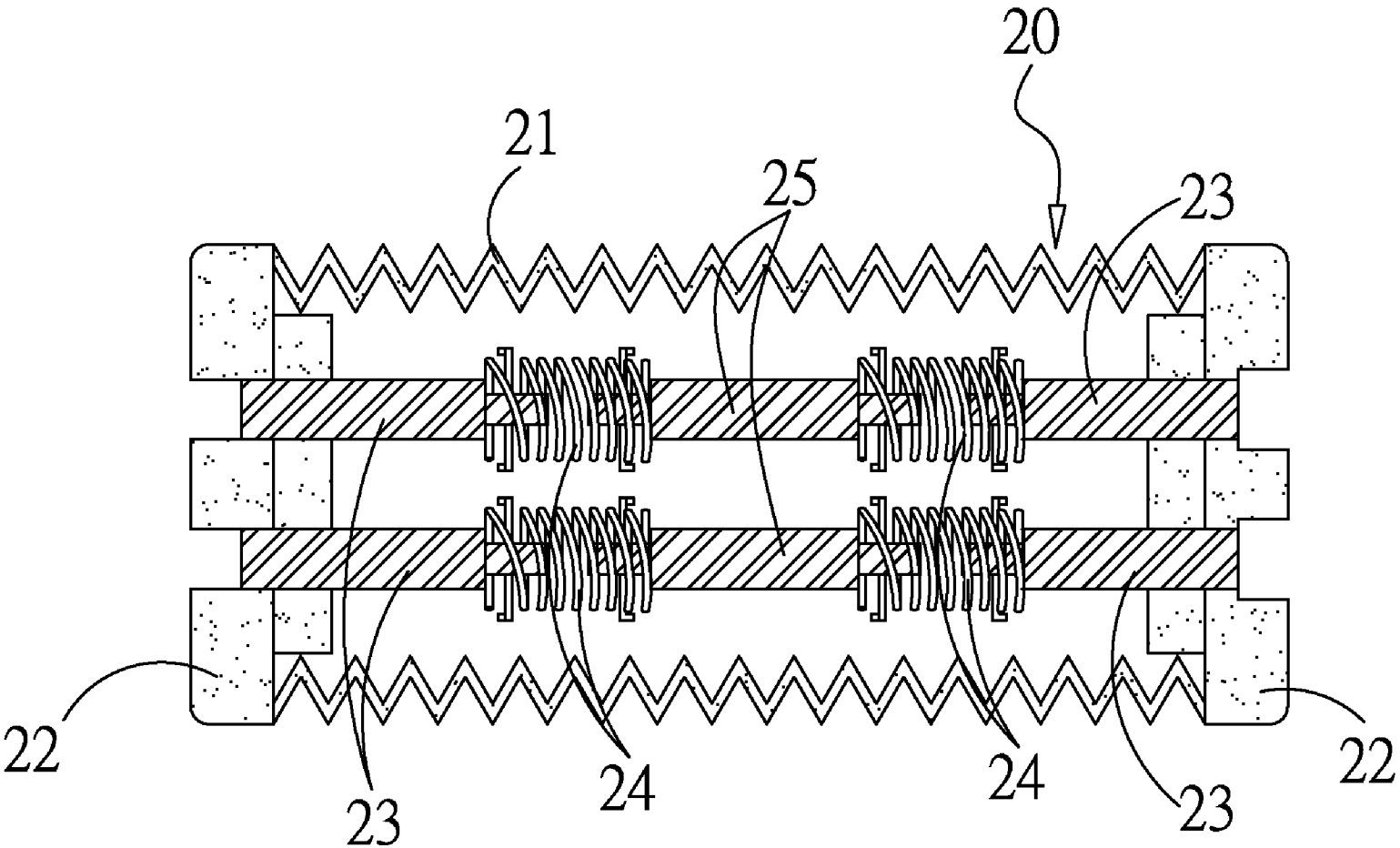
FIG. 4 is a cross-sectional drawing of a lamp tube coupler in a retractable state according to a first embodiment of the present invention.

With reference to FIG. 2 and FIG. 3 for a lamp tube coupler 20 in accordance with the present invention, the lamp tube coupler 20 comprises an expansible outer cylinder 21, two insulation terminal seats 22 and two pairs of electrode coupling members 23, wherein the expansible outer cylinder 21 is a woven net composed of metal wires. Two ends of the expansible outer cylinder 21 can generate the expansion effect of relative stretch (as shown in FIG. 3) or relative squeeze (as shown in FIG. 4) by utilizing the relatively interlace shift between the metal wires.

The two insulation terminal seats 22 are respectively disposed to two ends of the expansible outer cylinder 21. A terminal face of each insulation terminal seat 22 is provided with a pair of assembly holes 221, which pass through the expansible outer cylinder 21, for assembling the electrode coupling members 23.

The two pairs of electrode coupling members 23 are respectively fastened to the assembly holes 221 of each insulation terminal seat 22 and composed of metal bars or metal sheets. The electrode coupling members 23 corresponding to each other at two ends of the expansible outer cylinder 21 form a conduction mode through respective springs 24. In the embodiment, two metal bars 25 disposed inside the expansible outer cylinder 21 of each lamp tube coupler 20 are respectively connected to the springs 24 belonging to the electrode coupling members 23 which correspond to each other at two ends of the expansible outer cylinder 21, thereby increasing the stability of the whole structure.

Figure 5:
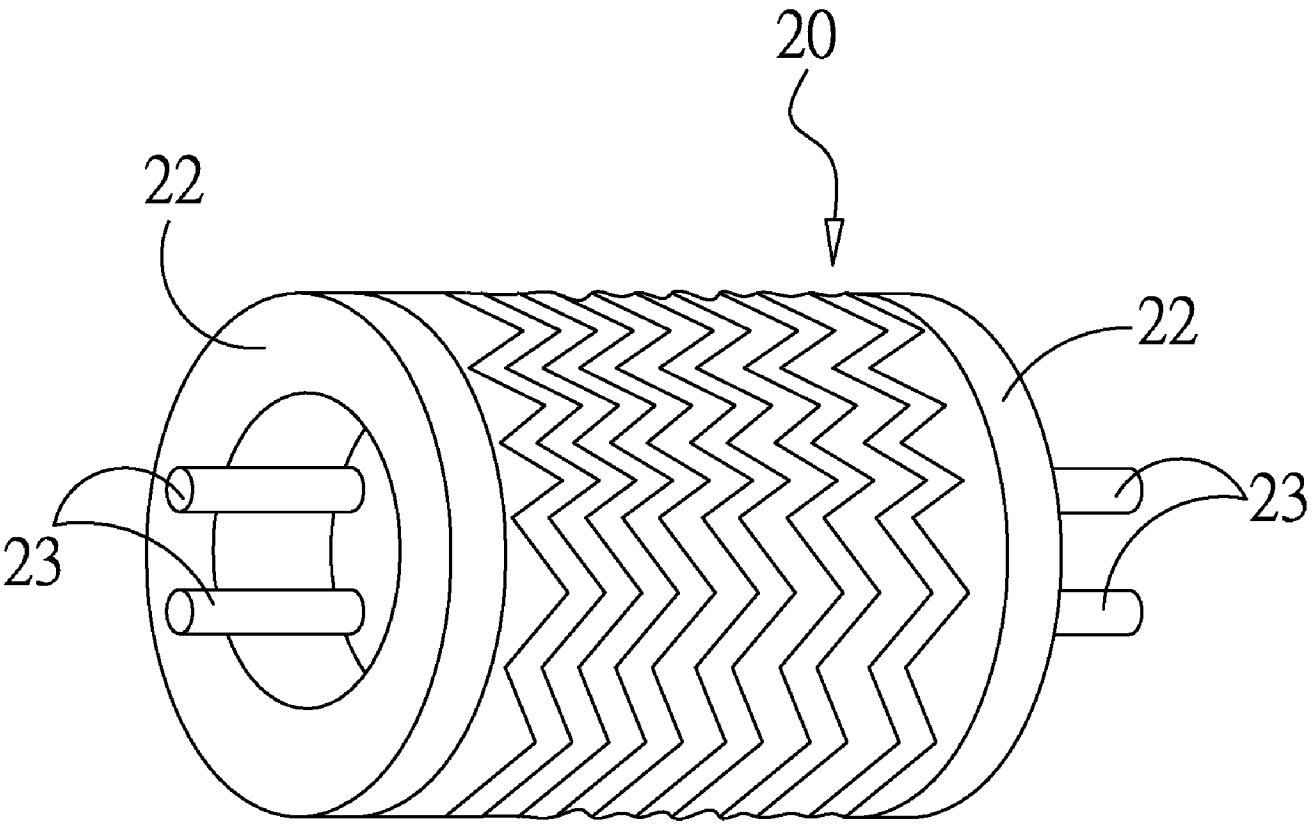
FIG. 5 is a structural diagram of a lamp tube coupler according to a second embodiment of the present invention.

The electrode coupling members 23 at two ends of each lamp tube coupler 20 can be relatively recessed in the insulation terminal seats 22 as shown in FIG. 2, relatively protruded from the insulation terminal seats 22 as shown in FIG. 5. Alternatively, the electrode coupling members 23 at one end of each lamp tube coupler 20 are relatively recessed in the insulation terminal seats while the electrode coupling members 23 at another end of each lamp tube coupler 20 are relatively protruded from the insulation terminal seats, thereby selecting and utilizing the required structure with respect to the actual demands.

Figure 6:
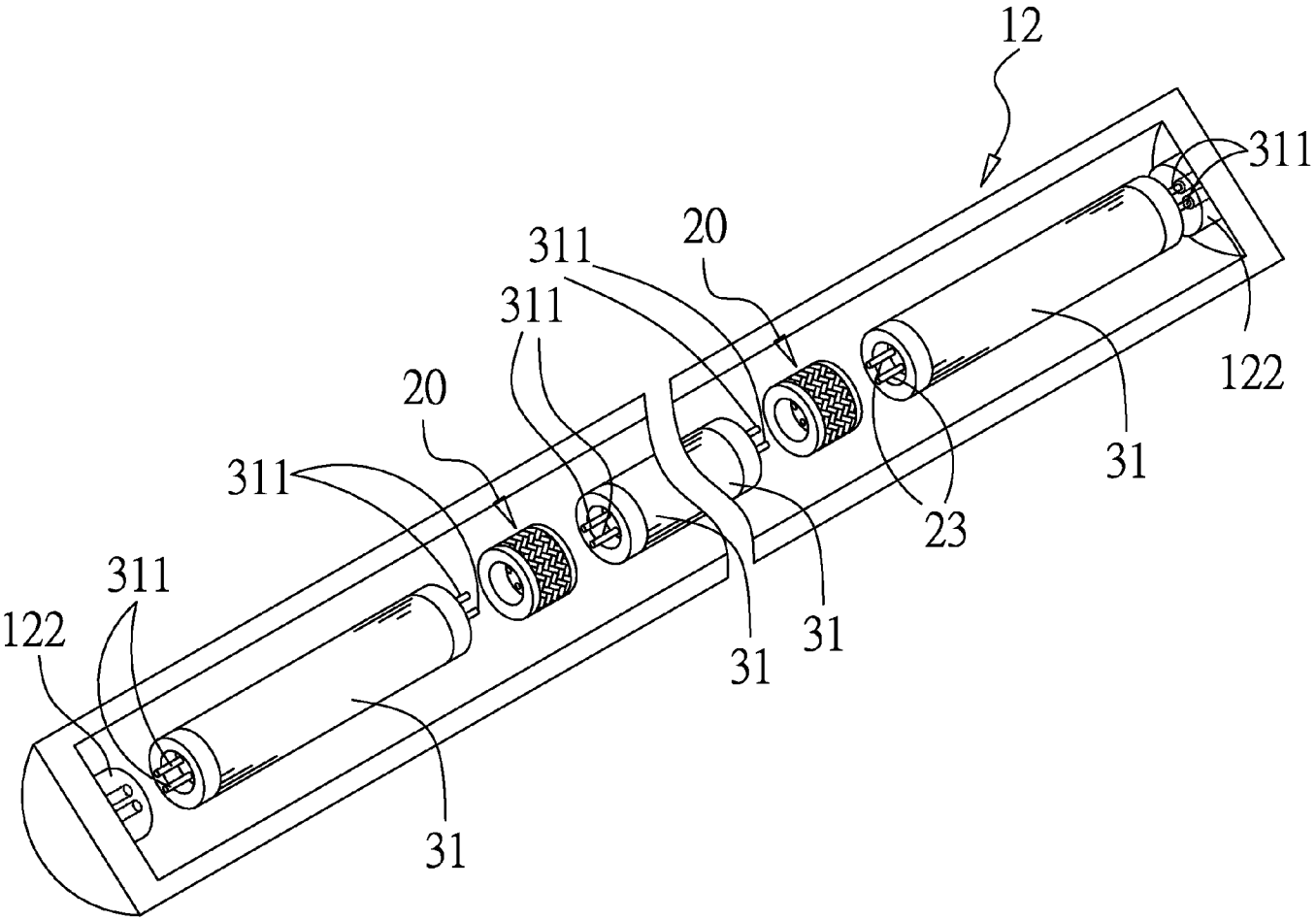
FIG. 6 is a reference diagram of a lamp tube coupler in a usage state according to a first embodiment of the present invention.

As shown in FIG. 6, while using every lamp tube coupler 20, the lamp tube coupler 20 is disposed between two lamp tubes 31, and the electrode coupling members 23 at the two ends of the lamp tube coupler 20 are respectively inserted with electrode joints 311 of the two lamp tubes 31 to achieve the goal of cascading at least two lamp tubes 31. The lengths of all cascaded lamp tubes 31 match the intervals of the electrode sockets 122 of the lamp holder 12. Thus the applicability of the lamp tubes 31 and the lamp holder 12 can be increased. Moreover, the lamp tubes with different lengths and specifications can be interchanged to relatively decrease the cost of repeatedly purchasing the lamp tube and to reduce the inconvenience of storing the lamp tubes.

The present invention improves over the prior art and complies with patent application requirements, and thus is duly filed for patent application. While the invention has been described by device of specific embodiments, numerous modifications and variations could be made thereto by those generally skilled in the art without departing from the scope and spirit of the invention set forth in the claims.

What is claimed is:

1. A lamp tube coupler comprising:

an expansible outer cylinder;

two insulation terminal seats respectively disposed to two ends of the expansible outer cylinder;

two pairs of electrode coupling members correspondingly protruded from or recessed in the insulation terminal seat and respectively fastened to two sides of each insulation terminal seat; and the electrode coupling members corresponding to each other at two ends of the expansible outer cylinder form a conduction mode through respective springs.

2. The lamp tube coupler as recited in claim 1, wherein the electrode coupling members at two ends are correspondingly recessed in the insulation terminal seats.

3. The lamp tube coupler as recited in claim 1, wherein the electrode coupling members at two ends are correspondingly protruded from the insulation terminal seats.

4. The lamp tube coupler as recited in claim 1, wherein the electrode coupling members at one end are recessed in the insulation terminal seat, and the electrode coupling members at another end are protruded from the insulation terminal seat.

5. The lamp tube coupler as recited in claim 1, wherein the expansible outer cylinder is a woven net structure body composed of metal wires.

6. The lamp tube coupler as recited in claim 1, wherein terminal faces of the insulation terminal seat are provided with a pair of assembly holes, which pass through an inside of the expansible outer cylinder, for assembling the electrode coupling members.

7. The lamp tube coupler as recited in claim 1, wherein each electrode coupling member is composed of a metal bar.

8. The lamp tube coupler as recited in claim 1, wherein each electrode coupling member is composed of a metal sheet.

9. The lamp tube coupler as recited in claim 1, wherein the expansible outer cylinder is provided with two metal bars therein respectively connected to the springs belonging to the electrode coupling members which correspond to each other at the two ends of the expansible outer cylinder.

* * * * *